US006276146B1

(12) United States Patent
Kim et al.

(10) Patent No.: US 6,276,146 B1
(45) Date of Patent: Aug. 21, 2001

(54) METHOD FOR CONTROLLING THE PURIFIED WATER PASSAGE OF A REFRIGERATOR WITH A WATER PURIFYING FILTER

(75) Inventors: Ill Shin Kim; Yong-Chol Kwon; Si-Jae Kim, all of Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/589,276

(22) Filed: Jun. 8, 2000

(30) Foreign Application Priority Data

Jun. 8, 1999 (KR) ..... 99-21212

(51) Int. Cl.[7] ..... F25C 1/00
(52) U.S. Cl. ..... 62/66; 62/233; 62/338
(58) Field of Search ..... 62/66, 98, 233, 62/340, 338, 339, 389; 210/416.3, 435

(56) References Cited

U.S. PATENT DOCUMENTS 5,083,442 * 1/1992 Vlock ..... 62/338
5,135,645 * 8/1992 Sklenak et al. ..... 62/338
5,715,699 * 2/1998 Coates et al. ..... 62/338
5,737,932 * 4/1998 Lee ..... 62/340
6,092,374 * 7/2000 Kang et al. ..... 62/233

* cited by examiner

*Primary Examiner*—William E. Tapolcai

(57) ABSTRACT

A method for controlling the purified water passage of a refrigerator with a water purifying filter is disclosed. The refrigerator has a first valve for controlling water supply to the water purifying filter and a second valve for controlling water supply to a dispenser and an ice-making unit. The method comprises the following steps. A first step is determining whether the dispenser and the ice-making unit are operated. A second step is opening the first and second valves if the dispenser and the ice-making unit are operated. A third step is determining whether a refrigerator compartment door and a freezer compartment door are closed if one of the dispenser and the ice-making unit is operated. A fourth step is closing the first and second valves if at least one of the refrigerator compartment door and the freezer compartment door is opened. A fifth step is closing the first and second valves if the dispenser and the ice-making unit are not operated.

3 Claims, 3 Drawing Sheets

METHOD FOR CONTROLLING THE PURIFIED WATER PASSAGE OF A REFRIGERATOR WITH A WATER PURIFYING FILTER

BACKGROUND OF THE INVENTION

1. Field of the Invention

The present invention relates, in general, to a method for controlling the purified water passage of a refrigerator with a water purifying filter and, more particularly, to a method for controlling the purified water passage of a refrigerator with a water purifying filter, which is capable of protecting the filter from being damaged.

2. Description of the Prior Art

As well known to those skilled in the art, some refrigerators have water purifying filters in their interiors, thereby supplying water purified by the filters to the outside of the refrigerators or producing ice using water purified by the filters.

FIG. 1 is a schematic perspective view showing the purified water passage of a conventional refrigerator with a water purifying filter. The conventional refrigerator comprises a refrigerator compartment 10 and a freezer compartment 20 that are partitioned by a barrier BR. A machine room 30 is positioned under the refrigerator compartment 10 and the freezer compartment 20.

A first valve 32 and a second valve 34 are mounted to the machine room 30. The first valve 32 serves to arrest water entering the interior of the refrigerator from a water pipe when an old filter is exchanged for a new one, and the second valve 34 serves to dispense purified water to the various portions of the refrigerator. The first and second valves 32 and 34 are solenoid valves, and are opened or closed by means of the attraction of a magnetic field that is generated when electric current is applied to the valves 32 and 34.

A water purifying filter 12 that is mounted to the refrigerator compartment 10 is connected to the first valve 32 via a connecting conduit D1. The filter 12 serves to purify water that has entered the refrigerator. A tank 14 is positioned on one side of the refrigerator compartment 10 and connected to the water purifying filter 12 and the second valve 34 respectively via a connecting conduit D2 and a connecting conduit D3. Water that has been purified in the filter 12 is stored in the tank 14 temporarily before it is supplied to a dispenser (will be described).

A refrigerator compartment door switch 16*a* is mounted to the refrigerator compartment door 16 and serves to inform a Central Processing Unit (CPU, will be described) whether the refrigerator compartment door is opened or not.

In the meantime, an ice-making unit 24 is mounted to the freezer compartment 20 and connected to the second valve 34 via a connecting conduit D4. An ice-making unit switch 24*a* that is positioned on one side of the ice-making unit 24 transmits a signal to the CPU when purified water is needed so as to make ice.

The dispenser 22 is mounted to one side of the freezer compartment 20 so as to supply the purified water to the outside of the refrigerator, and connected to the tank 14 via a connecting conduit D5. A dispenser switch 22*a* that is mounted to one side of the dispenser 22 transmits a signal to the CPU so as to supply the purified water to the outside of the refrigerator.

A freezer compartment door switch 26*a* is mounted to the freezer compartment door 16 and serves to inform the CPU whether the freezer compartment door 26 is opened or not.

With reference to FIGS. 2 and 3, a conventional method for controlling the purified water passage of the refrigerator with a water purifying filter will be described in detail.

Referring to FIG. 2, the CPU controls a first valve control 32*a* and a second valve control 34*a* in accordance with a preset control program in response to signals from the refrigerator compartment door switch 16*a*, the freezer compartment door switch 26*a*, the dispenser switch 22*a* and the ice-making unit switch 24*a*. That is, the first and second valve 32 and 34 are opened or closed in response to the signals of the refrigerator compartment door switch 16*a*, the freezer compartment door switch 26*a*, the dispenser switch 22*a* and the ice-making unit switch 24*a*.

FIG. 3 is a flowchart showing the conventional method for controlling the purified water passage of the refrigerator with a water purifying filter so as to control the opening of the first and second valves 32 and 34.

In accordance with the flowchart, the conventional purified water passage control method starts from the step of determining whether the refrigerator compartment door switch 16*a* is OFF (STEP 110). If the refrigerator compartment door switch 16*a* is OFF, that is, the refrigerator compartment door 16 is opened, the first and second switches 32 and 34 are closed (STEP 111). The reason why the first valve 32 is closed while the refrigerator compartment door 16 is opened is to prevent water from being supplied to the filter 12 when an old filter is exchanged for a new one.

On the other hand, if the refrigerator compartment door switch 16*a* is ON (NO in STEP 110), the step of determining whether the freezer compartment door switch 26*a* is OFF (STEP 112) is performed. If the freezer compartment door 26 is opened, and so the freezer compartment door switch 26*a* is OFF, the first valve 32 is opened and the second valve 34 is closed (STEP 113). That is, water that has passed through the opened first valve 32 is supplied to the filter 12 of the refrigerator compartment 10 via the connecting conduit D1. Additionally, water that is purified in the filter 12 is supplied to the second valve 34 of the machine room 30 via the connecting conduit D2. In such a case, since the second valve 34 is closed, purified water is not supplied to the ice-making unit 24 and the dispenser 22 while the refrigerator compartment door 26 is opened. The reason why the second valve 34 is closed while the freezer compartment door is opened is to prevent water from being leaked via the dispenser 22.

If the freezer compartment door switch 26*a* is ON (NO in STEP 112), the step of determining whether the dispenser switch 22*a* and the ice-making unit switch 24*a* are OFF (STEP 114) is performed. If the dispenser switch 22*a* and the ice-making unit switch 24*a* are OFF, the first valve 32 is opened and the second valve 34 is closed (STEP 116). As a result, since the first valve 32 is opened when water supply to the dispenser 22 and the ice-making unit 24 is not needed while the freezer compartment door 26 is closed, water is supplied to the filter 12 and is not supplied to the dispenser 22 and the ice-making unit 24.

On the other hand, when at least one of the dispenser switch 22*a* and the ice-making unit switch 24*a* is ON because water supply to at least one of the dispenser 22 and the ice-making unit 24 is needed, the first and second valves 32 and 34 are opened (STEP 115), so that water is supplied to the dispenser switch 22 and the ice-making unit 24.

The conventional method for controlling the purified water passage of the refrigerator constructed above has the following defects.

As known from the flowchart of FIG. 3, the opening and closing of the first valve 32 depends upon whether the refrigerator compartment door 16 is opened or not. That is, the first valve 32 is closed when the refrigerator compartment door 16 is opened, while the first valve 32 is opened when the refrigerator compartment door 16 is closed. Therefore, regardless of whether the second valve 34 is opened or not, or when water supply to the refrigerator is not needed, the first valve 32 is opened, so that water is continuously supplied to the filter 12 that is connected to the first valve 32. In such a case, since water is continuously supplied while water that has passed through the filter 12 is intercepted by the second valve 34, high water pressure is exerted on the filter 12. Since the filter 12 is mostly made of a minute material that is weak and subject to impact damage, such high water pressure may cause the filter 12 to be damaged.

Additionally, since water is continuously supplied to the filter 12, the amount of purified water is increased, and so the amount of impurities that are accumulated in the filter 12 is increased, also. Consequently, since the filter 12 is made of a weak material, the filter 12 is damaged by solid materials, thereby reducing the life span of the filter 12.

Further, whenever the freezer compartment door 26 is opened, the second valve 34 is closed unconditionally regardless of the ON/OFF of the dispenser switch 22*a* and the ice-making unit switch 24*a*. Therefore, it is impossible for a user to control the amount of supplied water after opening the freezer compartment door 26 and inspecting the amount of water that is being supplied to the ice-making unit 24.

SUMMARY OF THE INVENTION

Accordingly, the present invention has been made keeping in mind the above problems occurring in the prior art, and an object of the present invention is to provide a method for controlling the purified water passage of a refrigerator with a water purifying filter, which is capable of minimizing the period of time for which water pressure has been exerted to the filter and the amount of impurities that are accumulated in the filter, thereby protecting the filter from being damaged and, consequently, lengthening the life span of the filter.

Another object of the present invention is to provide a method for controlling the purified water passage of a refrigerator with a water purifying filter, which is capable of inspecting the amount of water that is being supplied to the ice-making unit 24 and, consequently, controlling the amount of supplied water.

In order to accomplish the above objects, the present invention provides a method for controlling the purified water passage of a refrigerator with a water purifying filter, the refrigerator having a first valve for controlling water supply to the water purifying filter and a second valve for controlling water supply to a dispenser and an ice-making unit, comprising the steps of determining whether the dispenser and the ice-making unit are operated, opening the first and second valves if the dispenser and the ice-making unit are operated, determining whether a refrigerator compartment door and a freezer compartment door are closed if one of the dispenser and the ice-making unit is operated, closing the first and second valves if at least one of the refrigerator compartment door and the freezer compartment door is opened, and closing the first and second valves if the dispenser and the ice-making unit are not operated.

Preferably, the method may further comprise the step of opening the first and second valves if the refrigerator compartment door and the freezer compartment door are closed.

Preferably, the method may further comprise the steps of measuring the amount of water that is supplied to the ice-making unit while the first and second valves are opened, and setting a time period of water supply on the basis of the measured account of supplied water.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
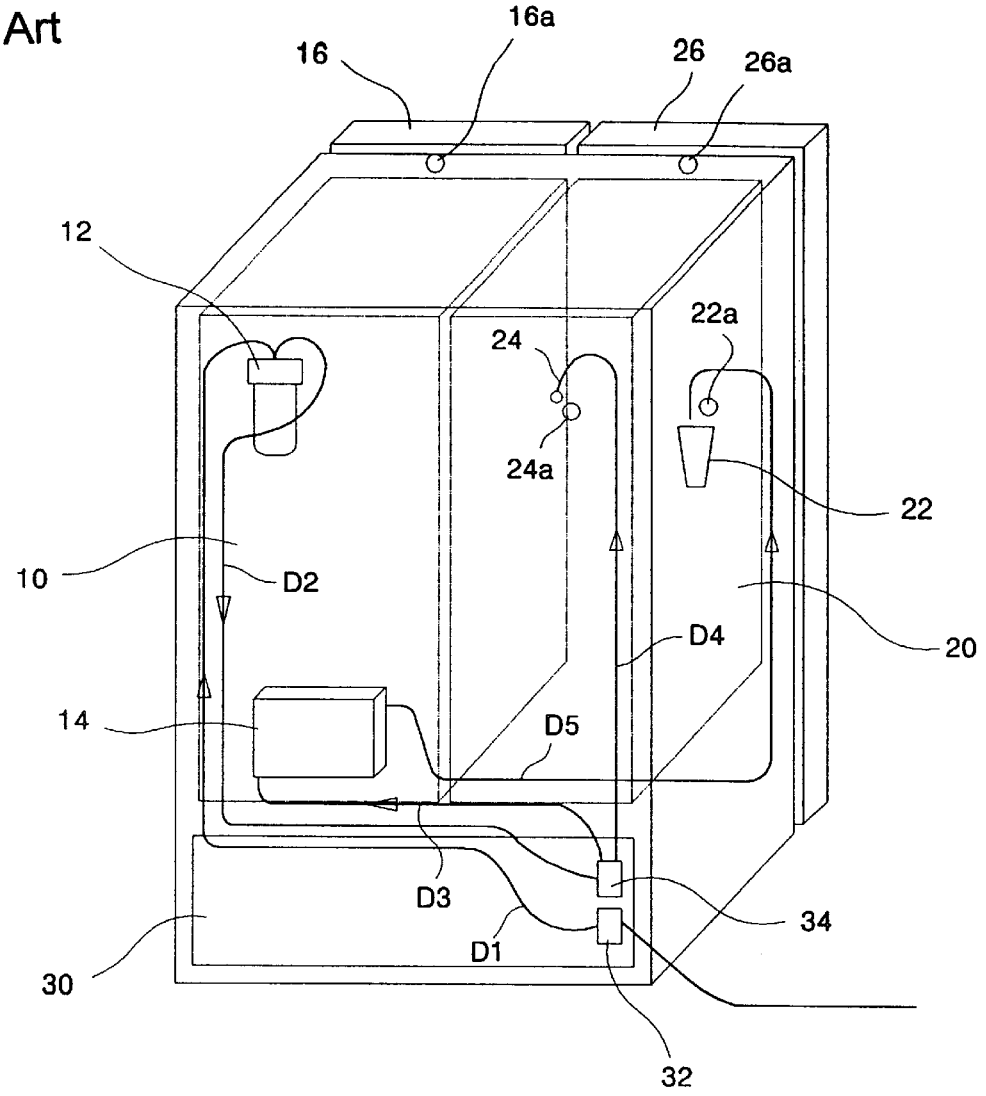
Fig 1 Prior Art
FIG. 1 is a schematic perspective view showing the purified water passage of a conventional refrigerator with a water purifying filter.
Figure 2:
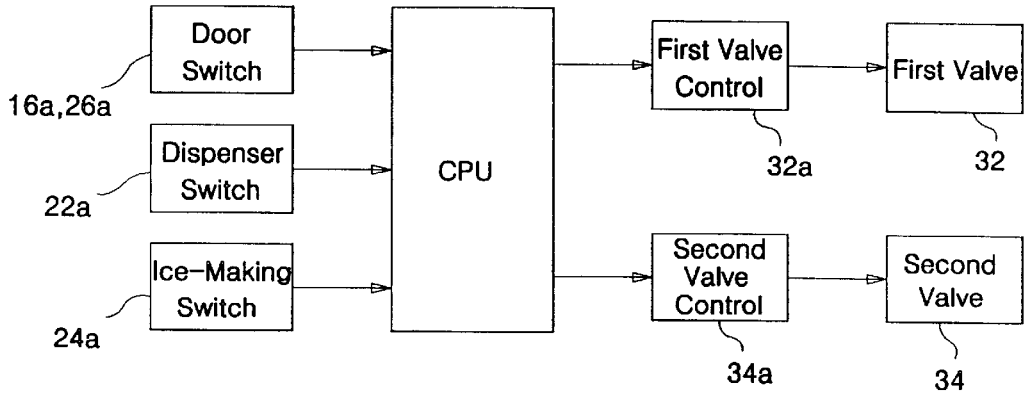
Fig 2 Prior Art
FIG. 2 is a block diagram showing the construction of a control system to which a conventional method for controlling the purified water passage of a refrigerator with a water purifying filter may be applied.
Figure 3:
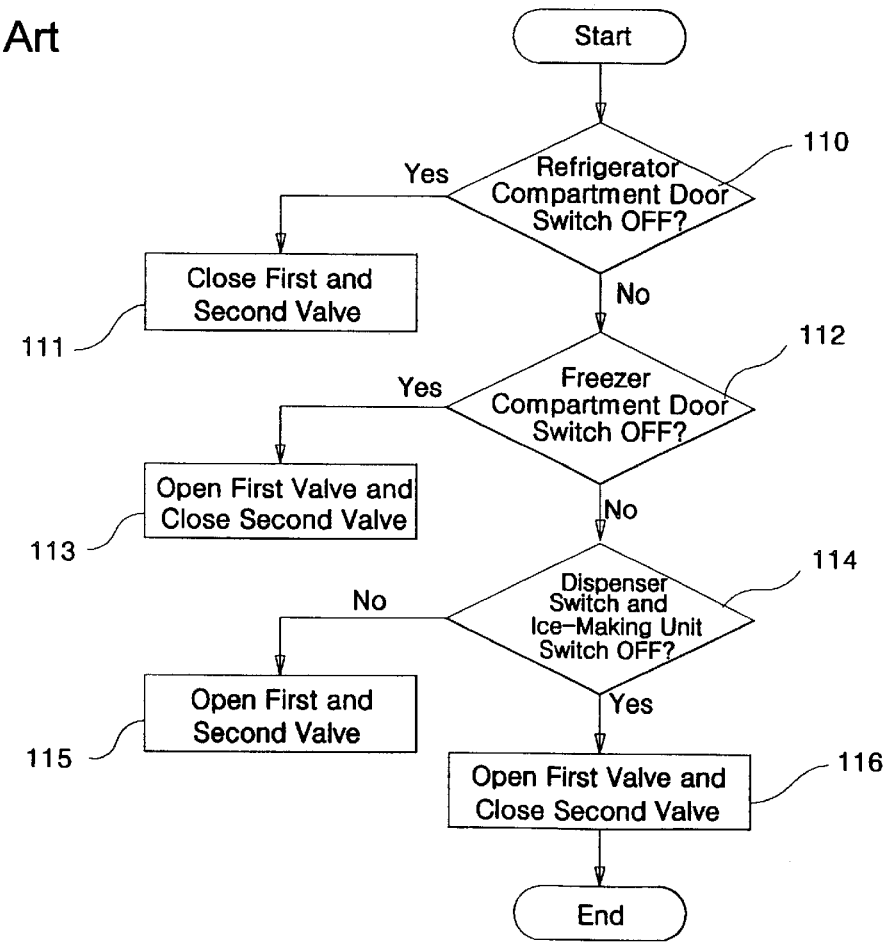
Fig 3 Prior Art
FIG. 3 is a flowchart showing a conventional method for controlling the purified water passage of the refrigerator with a water purifying filter.

Reference now should be made to the drawings, in which the same reference numerals are used throughout the different drawings to designate the same or similar components.

Figure 4:
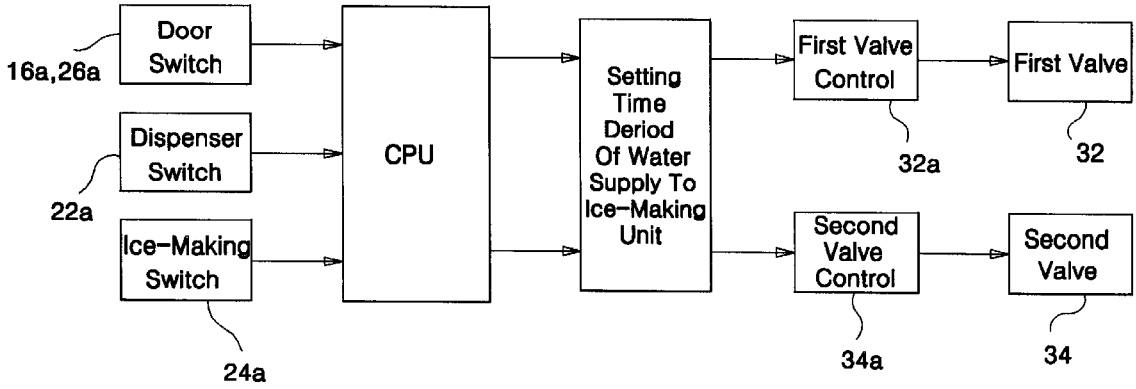
FIG. 4 is a block diagram showing the construction of a control system to which a method for controlling the purified water passage of a refrigerator with a water purifying filter in accordance with the present invention may be applied.

FIG. 4 is a block diagram showing the construction of a control system to which a method for controlling the purified water passage of a refrigerator with a water purifying filter in accordance with the present invention may be applied. As illustrated in FIG. 4, a CPU processes signals from a refrigerator compartment door switch 16*a*, a freezer compartment door switch 26*a*, a dispenser switch 22*a* and an ice-making unit switch 24*a* in accordance with a preset control program.

Additionally, a time schedule (a water supply time schedule for the ice-making unit 24) on which purified water is supplied to an ice-making unit 24 and which is determined in accordance with the actual water pressure of an installation area and a user's need is input to the CPU. The CPU controls a first valve control 32*a* and a second valve control 34*a* by operating a first valve control 32*a* and a second valve control 34*a* in accordance with the preset control program and a time period of water supply for the ice-making unit in response to signals from the refrigerator compartment door switch 16*a*, the freezer compartment door switch 26*a*, the dispenser switch 22*a* and the ice-making unit switch 24*a*.

The method for controlling the purified water passage of a refrigerator with a water purifying filter in accordance with the present invention includes the step of setting the time period of water supply for the ice-making unit differently from the conventional method for controlling the purified water passage of a refrigerator with a water purifying filter. The reason why it is possible to include the step of setting the time period of water supply is that the first and second valves 32 and 34 are opened during the operation of the ice-making unit 24 and a dispenser 22 regardless of the opening of a refrigerator compartment door 16 and the freezer compartment door 26, in accordance with the purified water passage control method of the present invention.

Figure 5:
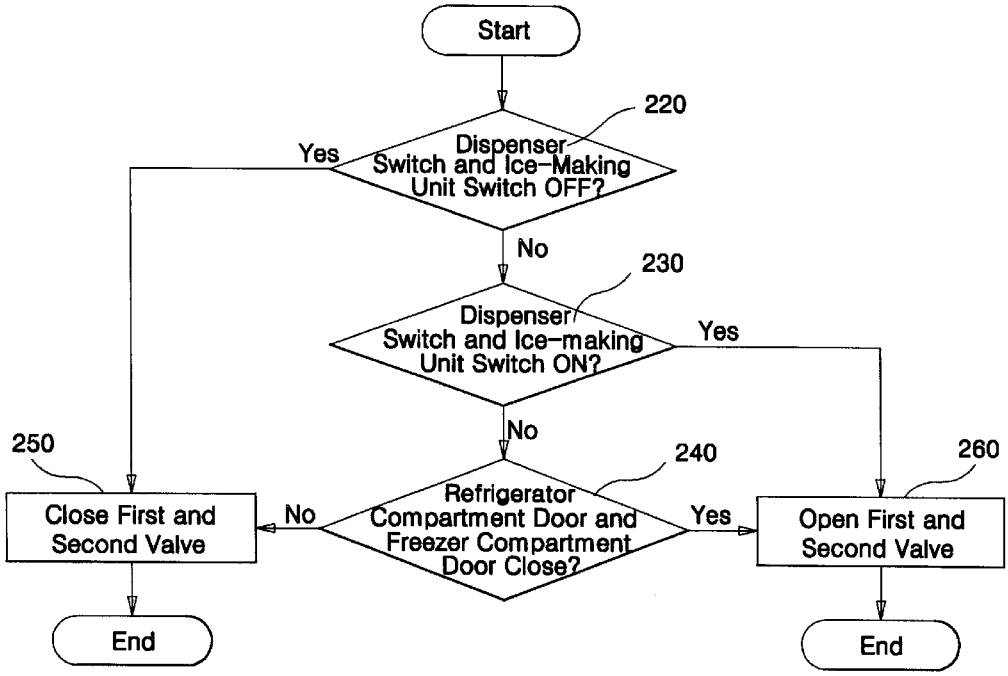
FIG. 5 is a flowchart showing a method for controlling the purified water passage of the refrigerator with a water purifying filter, in accordance with the present invention.

FIG. 5 is a flowchart explaining the control program, and the control program is described in the following. In the following, the ON state of the refrigerator compartment door switch 16*a* refers to the closed state of the refrigerator compartment door 16, and the ON state of the freezer compartment door switch 26*a* refers to the closed state of the freezer compartment door 26.

As shown in FIG. 5, the purified water passage control method of the present invention starts from the step of determining whether both the dispenser switch 22*a* and the ice-making unit switch 24*a* are OFF (STEP 220). If both the dispenser switch 22*a* and the ice-making unit switch 24*a* are OFF, the first and second valves 22*a* and 24*a* are kept in a closed state (STEP 250).

If at least one of the dispenser switch 22*a* and the ice-making unit switch 24*a* is ON (NO in STEP 220), the step of determining whether the ice-making unit switch 24*a* and the dispenser switch 22*a* are ON (STEP 230).

If only one of the ice-making unit switch 24*a* and the dispenser switch 22*a* is ON, the step of determining whether the refrigerator compartment door 16 and the freezer compartment door 26 are closed is performed (STEP 240).

If at least one of the refrigerator compartment door 16 and the freezer compartment door 26 is opened (NO in STEP 240), the first and second valves 22*a* and 24*a* are kept in a closed state (STEP 250). The reason why the first and second valves 22*a* and 24*a* are closed when at least one of the refrigerator compartment door 16 and the freezer compartment door 26 is opened is that water is prevented from being supplied to the filter 12 when an old filter is exchanged with a new one and flowing through the dispenser 22 when the freezer compartment door 26 is opened.

If both the refrigerator compartment door 16 and the freezer compartment door 26 are closed (NO in STEP 240), the first and second valves 22*a* and 24*a* are opened (STEP 260). When the first and second valves 22*a* and 24*a* are opened, water is supplied to the water purifying filter 12 and water that has been purified in the water purifying filter 12 is supplied to the second valve 34 via a connecting conduit D2. The water that has been supplied to the water purifying filter 12 passes through a tank 14 and, subsequently, is supplied to the dispenser 22 and the ice-making unit 24.

In accordance with the method for controlling the purified water passage of a refrigerator with a water purifying filter of the present invention, only when the dispenser switch 22*a* and/or the ice-making unit switch 24*a* is ON, that is, purified water supply to the dispenser 22 and/or the ice-making unit 24 is needed, the first and second valves 22*a* and 24*a* are opened at the same time. Therefore, in comparison with the prior art wherein the first valve 32 is opened regardless of the necessity of water supply when the refrigerator compartment door 16 is closed and even when the second valve 34 is closed, the amount of water that is supplied to the water purifying filter 12 and the time period of water supply are considerably reduced.

In the meantime, if both the dispenser switch 22*a* and the ice-making unit switch 24*a* are ON (YES in STEP 230), the first and second valves 22*a* and 24*a* are opened (STEP 260) regardless of whether the refrigerator compartment door 16 and/or the freezer compartment door 26 are closed or not. Therefore, when the ice-making unit 24 is operated, a user inspects the amount of water supplied to the ice-making unit 24 by operating the dispenser 22 while the freezer compartment door 26 is opened, and can reset a new time period of water supply for the ice-making unit 24 by manipulating the microprocessor of the CPU. When the user opens the refrigerator compartment door 26 while the ice-making unit 24 is operated, the first and second valves 32 and 34 are kept to be closed in accordance with STEPS 240 and 250. However, in such a case, when the user operates the dispenser 22, the CPU considers the ON state of the dispenser switch 22*a* before whether the freezer compartment door 26 is opened or not (STEPS 220 and 230), and opens the first and second valves 32 and 34 (STEP 260). Therefore, when the above operation is not desired, the dispenser switch 22*a* is made to be OFF.

As described above, in accordance with the present invention, the amount of water that is being supplied to the ice-making unit 24 per a unit time period can be inspected. Therefore, on the basis of this, the user can control a time period of water supply for the ice-making unit 24 in accordance with the actual water pressure of an installation area and a user's need. That is, the preset time period of water supply is lengthened when the actual water pressure of an installation area is low or a large amount of ice is needed, whereas the preset time period of water supply is shortened when the actual water pressure of an installation area is high or a lesser amount of ice is needed. In such a case, the amount of ice that is manufactured in the ice-making unit 24 can be controlled by controlling the amount of supplied water. The control of the time period of water supply can be performed by manipulating the microprocessor of the CPU. Since the control of the time period of water supply by means of manipulating the microprocessor of the CPU is well known, an explanation of the technique is omitted.

As described above, since the first valve 32 is opened only when the second valve 34 is opened, the amount of water supplied to the filter 12 and the time period of purification can be minimized.

Additionally, since the first and second valves 32 and 34 can be opened while the freezer compartment door 26*a* are opened, the amount of water that is being supplied to the ice-making unit can be inspected.

As described above, the present invention provides a method for controlling the purified water passage of a refrigerator with a water purifying filter, which is capable of supplying water to the water purifying filter only when purified water supply is needed, thereby minimizing the period of time for which water pressure has been exerted to the filter and the amount of impurities that are accumulated in the filter, and, consequently, protecting the filter from being damaged and lengthening the life span of the filter.

Another object of the present invention is to provide a method for controlling the purified water passage of a refrigerator with a water purifying filter, which is capable of inspecting the amount of water that is being supplied to an ice-making unit, thereby allowing the amount of supplied water to be controlled and the amount of water that flows into the water purifying filter to be estimated for predicting the exchange of the water purifying filter.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for controlling the purified water passage of a refrigerator with a water purifying filter, the refrigerator having a first valve for controlling water supply to the water purifying filter and a second valve for controlling water supply to a dispenser and an ice-making unit, comprising the steps of:

determining whether the dispenser and the ice-making unit are operated;

opening the first and second valves if the dispenser and the ice-making unit are operated;

determining whether a refrigerator compartment door and a freezer compartment door are closed if one of the dispenser and the ice-making unit is operated;

closing the first and second valves if at least one of the refrigerator compartment door and the freezer compartment door is opened; and closing the first and second valves if the dispenser and the ice-making unit are not operated.

2. The method according to claim 1, further comprising the step of opening the first and second valves if the refrigerator compartment door and the freezer compartment door are closed.

3. The method according to claim 1, further comprising the steps of, measuring the amount of water that is supplied to the ice-making unit while the first and second valves are opened; and setting a time period of water supply on the basis of the measured amount of supplied water.

* * * * *